United States Patent [19]

Newman

[11] 4,397,241

[45] Aug. 9, 1983

[54] SYSTEM FOR LAYING A SEPARATION FABRIC ON THE SUBGRADE OF A RAILROAD BED

[76] Inventor: George R. Newman, 2421 Feather Run Trail, West Columbia, S.C. 29169

[21] Appl. No.: 77,103

[22] Filed: Sep. 19, 1979

[51] Int. Cl.[3] ..... E01B 1/00; E01B 37/00

[52] U.S. Cl. ..... 104/2; 238/2; 242/76; 242/86.52; 405/38; 405/258

[58] Field of Search ..... 104/1 R, 7 R, 7 A, 7 B; 238/2; 37/104–107; 171/16; 242/76, 86.52; 405/36, 38, 45, 258, 270

[56] References Cited

U.S. PATENT DOCUMENTS 3,368,729 2/1968 Connelly et al. ..... 242/76 X

FOREIGN PATENT DOCUMENTS 307476 5/1973 Austria ..... 104/2

550745 9/1956 Belgium ..... 242/86.52

*Primary Examiner*—Randolph Reese

[57] ABSTRACT

A system including method and apparatus for laying a separation fabric on the subgrade of a railroad bed. More particularly, the present invention provides a system for laying a separation fabric on the subgrade of an existing railway bed from which the ballast has been removed so that a continuous web of the material can be laid directly on the subgrade prior to reintroducing ballast back to the railway bed below the track and ties. When the ballast has been removed by apparatus such as an undercutter, the separation fabric is introduced without over stressing the track as by raising it high enough to accommodate a pay out roll of the fabric below the ties. The foregoing is accomplished by supporting a supply roll of fabric above the railway track generally parallel thereto, and directing the fabric web to a guide adjacent the bottom of the ties to a pay out roll or surface below the ties at an angle of approximately 45° with the track so that the web can be directed around the surface so as to leave the surface parallel to the railroad track to be deposited on the subgrade.

10 Claims, 3 Drawing Figures

SYSTEM FOR LAYING A SEPARATION FABRIC ON THE SUBGRADE OF A RAILROAD BED

BACKGROUND OF THE INVENTION

1. Field of the Invention

The subject system relates to railway maintenance equipment and particularly to upgrading existing railway track beds by introducing a subgrade stabilization fabric or geotextile material between the subgrade and ballast. There are many advantages to be gained by introducing such a material from providing a support membrane over a poor load bearing subgrade to assuring proper drainage. With the development of a variety of new geotextile materials which additionally provide a filtering function which not only syphons water away or allows it to pass partially through the material, but prevents fine particles from passing upwardly from the subgrade into the ballast thus contaminating it, such installations become more economically attractive.

2. Description of the Prior Art

The major problem presented in any attempt to introduce a separation fabric to the railway bed subgrade, is to economically accomplish such from the time of removing the ballast from under the railway track to the time or point of replacing the ballast. While particularly troublesome switch or crossing areas may justify manual placement of the fabric, installations of several hundred feet or more require some form of automation.

Early attempts to solve the problem of continuously introducing a separation material are shown in Austrian Pat. No. 307,476 which issued from Austrian patent application Ser. No. 8250/67 filed Sept. 8, 1967. In one embodiment, the material is introduced by spraying, pouring or injecting the material directly on the subgrade where it is allowed to harden to a plastic material. Such attempts usually employed a tar type material which does not possess the many desirable properties of the recently developed geotextile materials.

The other technique of introducing the separation material disclosed in the aforementioned Austrian patent is to locate a supply roll of the plastic foil, underneath the track, parallel to the ties along with a welder for joining adjoining adjacent individual strips. The apparent disadvantage of this device is that the space below the track will only accommodate small rolls of material requiring frequent roll changes and welds. If the track is locally lifted to accommodate a larger supply roll, danger of over stressing become obvious.

SUMMARY OF THE INVENTION

The system of the instant invention eliminates the difficulties inherent in the prior art devices. Specifically, the diameter of the supply roll of fabric to be laid is not limited by the space available below the ties when the ballast has been removed. More particularly, the supply roll is located on the track vehicle above the railroad track and generally longitudinally thereof. A guide member is supported on the structure longitudinally adjacent to and outside of the railroad track. In its simplest form this can be a stationary roll adjacent the bottom of the ties and parallel with the railroad track. The material from the top of the supply roll is directed downwardly around the guide roll passing towards the center of the track perpendicular thereto. A pay out member, also in its simplest form, can likewise be a stationary roll over which the web is passed. This pay out member is positioned transversely of the track and extending at least to the opposite ends of the tie at an oblique angle to the track to permit the web of fabric to be fed thereto and payed-out therefrom underneath the track in longitudinal alignment therewith. With the guide member being parallel with the track, the pay out member is arranged at an optimum angle of 45° with the railroad track.

DETAILED DESCRIPTION OF THE PREFERRED EMBODIMENT

Figure 1:
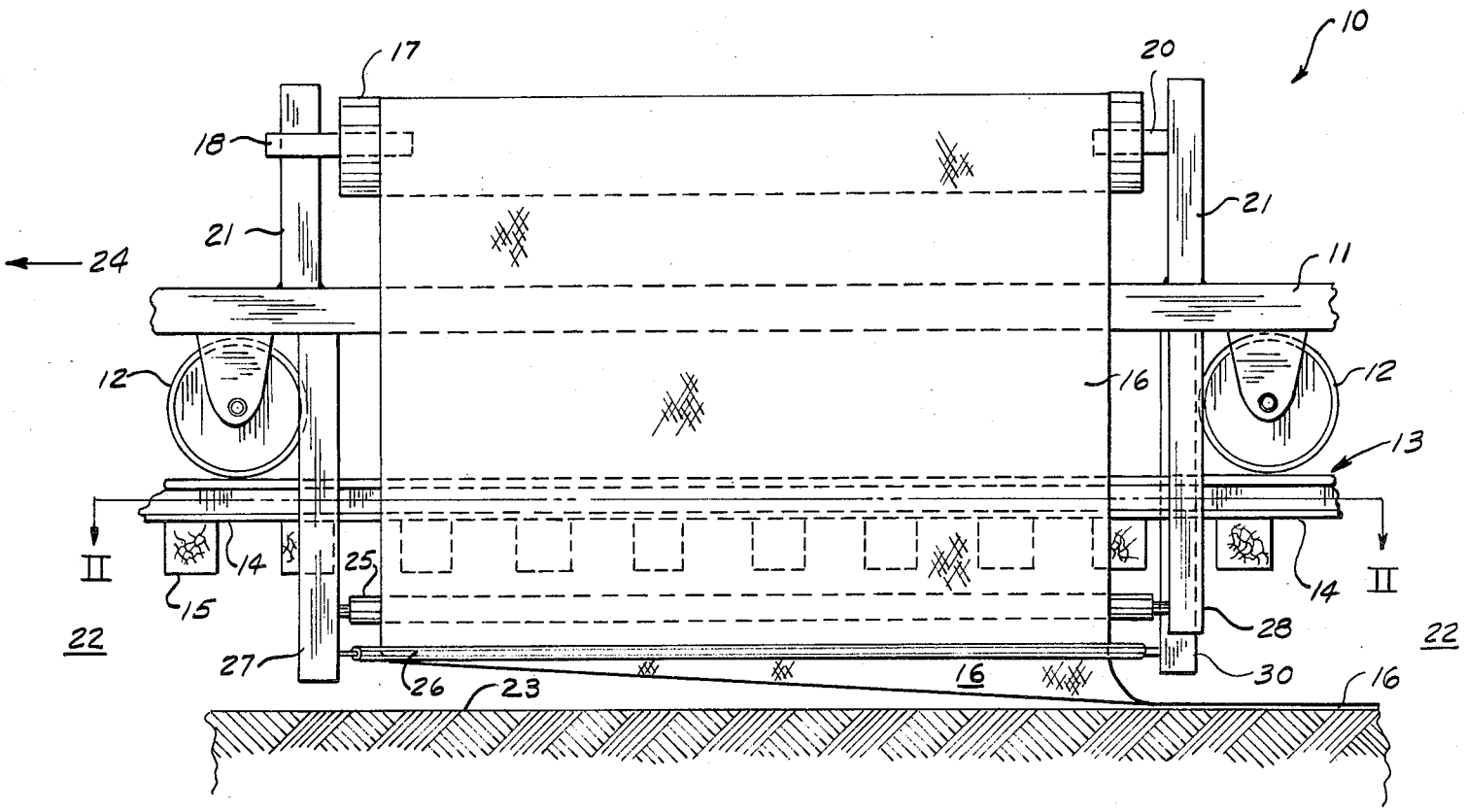
FIG. 1 is a side elevation of a schematic of a preferred embodiment of the invention showing a system for laying a separation fabric on subgrade of a railroad bed as it is adapted for use with a self-propelled railway vehicle.
Figure 3:
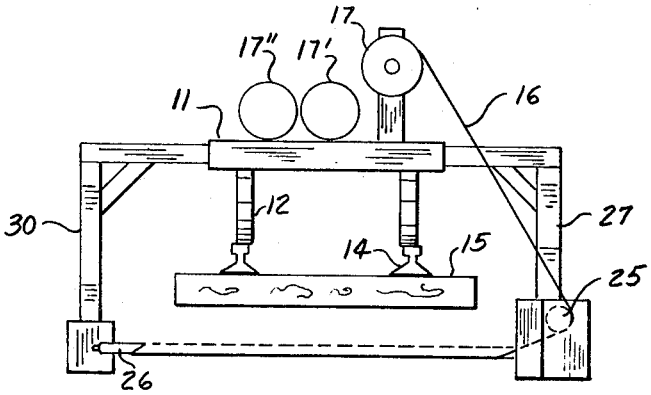
FIG. 3 is an end view, transverse to the railway track of the apparatus.

The apparatus 10 of the present invention depicts a system for laying a separation fabric in continuous web form on the subgrade of a railroad bed from which ballast has been previously removed. The system is adapted for mounting on a track maintenance vehicle such as the undercutting apparatus shown and described in U.S. Pat. No. 3,967,396 which is designed to remove the ballast from beneath the railroad track. The system 10 would be mounted on the vehicle frame behind the horizontal chain mechanism removing ballast. The system 10 can likewise be mounted on a track maintenance vehicle such as a ballast cleaner apparatus shown and described in British Pat. No. 1,453,457. Here the system would be mounted on the vehicle frame between the point where the ballast is excavated from beneath the track and the point where the cleaned ballast is redistributed back to the railway bed. FIGS. 1 and 3 show the system 10 mounted on an independent frame structure 11 which may be self-propelled or moved by other railway maintenance equipment such as the foregoing.

Frame 11 is mounted on railway wheels 12 for movement along railroad track 13 consisting of rails 14 and wooden ties 15. Separation fabric 16 to be layed is supplied by the manufacturer in continuous web form on rolls 17 having an internal core into which stationary arbors or shafts 18 and 20 can be inserted for mounting on upright supports 21 affixed to frame 11. Shaft 18 is shown as removable for easy replacement of supply roll 17. Supply roll 17 is mounted for application above and generally longitudinally of the railroad track 13. In the preferred form, supply roll 17 is supported in a position parallel with rails 14. As shown in FIG. 3 additional supply rolls 17' and 17'' can be supported on frame 11 to replace roll 17 when all of its fabric has been layed.

Figure 2:
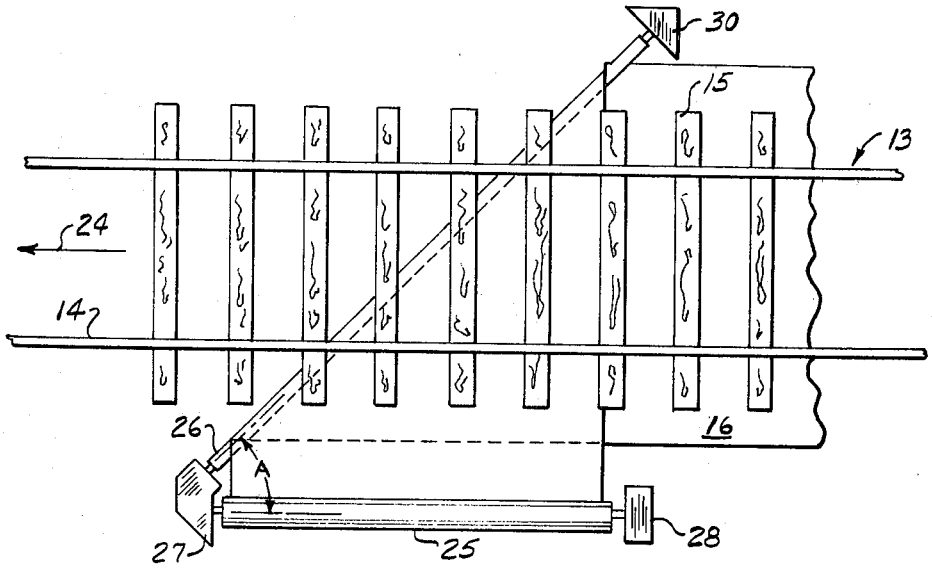
FIG. 2 is a plan view of the apparatus taken along line II—II of FIG. 1.

As best seen in FIG. 1, the ballast which normally supports railway track 13 has been removed from space 22 between the ties 15 and the subgrade 23. The railway track 13 and its ties 15 are supported above the subgrade before and aft from the position of frame 11 by railway maintenance equipment and/or suitable hand jacks (not shown). The separation fabric 16 is to be layed underneath the railway track 13 in space 22 so that the width of the fabric extends transversely of the track at least to the opposite ends of ties 15 and preferably beyond the ends of the ties to provide a drainage path away from the track. The separation fabric will be layed on the subgrade parallel to the railway track 13 as the frame 11 moves forward in the direction of work travel as shown by arrow 24 in FIGS. 1 and 2.

The separation fabric 16 is fed downwardly, from the top of supply roll 17, as best seen in FIG. 3, into space 22 beyond one end of ties 15 and then over the outside (transversely away from railway track 13) of a guide member 25. Guide member 25 is preferably in the form of a stationary roll, shaft or circular tube. Guide member 25 is in web receiving alignment with supply roll 17 and is preferably parallel to the axis of guide roll 17 and rails 14. The separation fabric is fed around the outside of member 25, transversely toward the center of railway track 13 from the lowest point of member 25 over the top of pay out member 26. Pay out member 26 is preferably in the form of a stationary roll, shaft or circular tube. Pay-out member 26 is in web receiving alignment with guide member 25 but at an oblique angle to the track to permit the separation fabric to pass from over the top of member 26 around it and exiting from the lowest part of member 26 into a direction in alignment with the track. Pay out member 26 is at an angel A to guide member 25. When guide member 25 is parallel to rails 14, the angle A will be 45° .

Guide member 25 is supported at each of its longitudinal ends by support members 27 and 28, attached to and depending from frame 11. Pay out member 26 is supported at one of its longitudinal ends by depending support member 27 and at its opposite end by depending support member 30 extending from frame 11 on the other side of the railway track 13 from members 27 and 28.

In operation, the continuous web of separation fabric 16 is fed from the top of supply roll 17, parallel with and outside of railway track 13 to a position adjacent to the bottom surface of ties 15. Fabric 16 is passed around guide member 25 so that the web leaves the guide surface perpendicular to the railroad track below the bottom surface of the ties. The web 16 is then passed around the top of pay out member 26 which is located at an angle of approximately 45° to the railroad track. The web leaves the bottom of pay out surface parallel to the railroad track on subgrade 23. The forward motion of frame 11 along the work direction indicated by arrow 24 causes the web of fabric to be pulled from journalled supply roll 17, around guide member 25 and pay out member 26 onto the subgrade 23.

What I claim as my invention is:

1. A system for laying a separation fabric in continuous web form on the subgrade of a railroad bed from which ballast has been removed, the fabric when laid extending transversely at least to the opposite ends of the ties, comprising, in combination: a structure mounted for movement on the railroad track in a working direction having means for supporting a supply roll of fabric above said railroad track and generally longitudinally thereof; a guide member supported on said structure longitudinally adjacent to and outside of said railroad track, in web receiving alignment with said means for supporting said supply roll; and a pay out member supported by said structure and extending transversely under said railroad track at least to the opposite ends of the ties in web receiving alignment with said guide member and at an oblique angle to said track to permit the web to be payed out underneath the track in longitudinal alignment therewith.

2. A system according to claim 1 wherein said supply roll and said guide member are supported in positions generally parallel to said railroad track and said pay out member extends at an angle of 45° to said railroad track.

3. A system according to claim 2 wherein the forward end of said pay out member, in the direction of track travel, is closest to said guide member.

4. A system according to claim 3 wherein the highest portion of said pay out member is below the lowest portion of said guide member.

5. A system for laying a separation fabric in continuous web form on the subgrade of a railroad bed from which ballast has been removed, the fabric when laid extending transversely at least to the opposite ends of the ties, comprising, in combination: a structure mounted for movement on the railroad track in working direction having means for supporting a supply roll of fabric above said railroad track and generally longitudinally thereof; a pay out member supported by said structure and adapted to extend transversely under said railroad track at least to the opposite ends of the ties and at an oblique angle to said track to permit a web of fabric to be fed thereto and payed out therefrom underneath the track in longitudinal alignment therewith, and means supported by said structure for conveying a web of fabric from said supply roll to said pay out member.

6. A system according to claim 5 wherein said conveying means constitutes a guide member adapted to be located longitudinally adjacent to and outside of said railroad track in web receiving alignment with the supply roll, and wherein the pay out member is in web receiving alignment with said guide member.

7. A system according to claim 6 wherein said supply roll and said guide member are supported in positions generally parallel to said railroad track and said pay out member extends at an angle of 45° to said railroad track.

8. A system for laying a separation fabric in continuous web form on the subgrade of a railroad bed, the fabric when laid extending transversely at least to the opposite ends of the ties, comprising, in combination: a structure mounted for movement on the railroad track in a working direction having means for supporting a supply roll of fabric above said railroad track and generally longitudinally thereof; a guide member supported on said structure longitudinally adjacent to and outside of said railroad track, in web receiving alignment with said means for supporting said supply roll; and a pay out member supported by said structure and extending transversely under said railroad track at least to the opposite ends of the ties in web receiving alignment with said guide member and at an oblique angle to said track to permit the web to be payed out underneath the track in longitudinal alignment therewith.

9. A method for laying a separation fabric in continuous web form on the subgrade of a railroad bed from which ballast has been removed, comprising the steps of locating a supply roll of fabric above and parallel with the railroad track; conveying the web from the top of the supply roll, parallel with and outside of a railroad track to a position adjacent the bottom surface of the ties; directing the web around a guide so that the web leaves the guide surface perpendicular to the railroad track below the bottom surface of the ties; locating a pay out surface extending transversely under said track beyond the opposite ends of the ties at an angle of approximately 45° to the railroad track; and directing the web around the top of said pay out surface and around the bottom of said surface, leaving said surface parallel to the railroad track and under the ties thereof.

10. A method for laying a separation fabric in continuous web form on the subgrade of a railroad bed comprising the steps of locating a supply roll of fabric above and parallel with the railroad track; conveying the web from the supply roll, parallel with and outside of a railroad track to a position adjacent the bottom surface of the ties; directing the web around a guide so that the web leaves the guide surface perpendicular to the railroad track below the bottom surface of the ties; locating a pay out surface extending transversely under said track beyond the opposite ends of the ties at an angle of approximately 45° to the railroad track; and directing the web around said pay out surface, leaving said surface parallel to the railroad track and under the ties thereof.

* * * * *